US009593529B2

(12) United States Patent
Haberland et al.

(10) Patent No.: US 9,593,529 B2
(45) Date of Patent: Mar. 14, 2017

(54) SPOOL ASSEMBLY

(71) Applicant: Centor Design Pty Ltd, Eagle Farm (AU)

(72) Inventors: Martin Haberland, Wynnum West (AU); Michael Smith, Hamilton (AU)

(73) Assignee: CENTOR DESIGN PTY LTD., Eagle Farm (AU)

( * ) Notice: Subject to any disclaimer, the term of this patent is extended or adjusted under 35 U.S.C. 154(b) by 125 days.

(21) Appl. No.: 14/429,626

(22) PCT Filed: Sep. 19, 2013

(86) PCT No.: PCT/AU2013/001067
§ 371 (c)(1),
(2) Date: Mar. 19, 2015

(87) PCT Pub. No.: WO2014/043753
PCT Pub. Date: Mar. 27, 2014

(65) Prior Publication Data

US 2015/0247363 A1 Sep. 3, 2015

(30) Foreign Application Priority Data

Sep. 19, 2012 (AU) ..... 2012904089

(51) Int. Cl.

| | |
|---|---|
| ***E06B 9/42*** | (2006.01) |
| ***E06B 9/56*** | (2006.01) |
| ***A47H 11/06*** | (2006.01) |
| ***E06B 9/44*** | (2006.01) |
| ***E06B 9/54*** | (2006.01) |

(52) U.S. Cl.
CPC ..... *E06B 9/56* (2013.01); *A47H 11/06* (2013.01); *E06B 9/44* (2013.01); *E06B 9/54* (2013.01)

(58) Field of Classification Search
CPC ..... E06B 9/42; E06B 9/44; E06B 9/54
USPC ..... 242/601, 602.1, 602.3, 613.1
See application file for complete search history.

(56) References Cited

U.S. PATENT DOCUMENTS

2008/0163988 A1* 7/2008 Hicks ..... E06B 9/54 160/267.1
2014/0352895 A1* 12/2014 Cheng ..... E06B 9/322 160/170

FOREIGN PATENT DOCUMENTS

| | | |
|---|---|---|
| FR | 2955606 | 7/2011 |
| GB | 2311269 | 9/1997 |
| GB | 2370308 | 6/2002 |
| WO | 2007068037 | 6/2007 |

OTHER PUBLICATIONS

English abstract of FR2955606, published Jul. 29, 2011.

* cited by examiner

*Primary Examiner* — Sang Kim
(74) *Attorney, Agent, or Firm* — Porter Wright Morris & Arthur LLP

(57) ABSTRACT

The spool assembly comprising a spool, a surface of the spool including one or more recesses in which a line member is adapted to be retained, and a cover portion adapted to be positioned over at least a portion of the spool such that, in use, the line member is prevented from passing between the spool and an inner surface of the cover portion.

11 Claims, 3 Drawing Sheets

SPOOL ASSEMBLY

TECHNICAL FIELD

The present invention relates to a spool assembly. In particular, the present invention relates to a spool assembly for use with sliding door or window assemblies.

BACKGROUND ART

In many sliding door and window assemblies, extendable screens (such as insect screens) or blinds are used. These screens or blinds are often fabricated from a flexible material that is wound on and off a rod when used.

In order to maintain tension in the screen or blind material, one or more tensioned cables are attached to the screen or blind. The cable or cables are themselves wound on and off a spool as the screen or blind is drawn across the door or window opening.

The drawback of conventional spool assemblies is that, should there be a loss of tension in the cable such as if the cable slips off a pulley or during installation, the installer accidentally drops a cable), the cable may simply slip off the spool. Facilitating the winding of the cable back onto the spool often involves the complete removal of the spool assembly from the door or window assembly. This is both time-consuming and fiddly, and there is a risk of damaging the cable and the spool during this process.

Thus, there would be an advantage if it were possible to provide a spool assembly that in instances of a loss of cable tension, was capable of preventing the cable from becoming disengaged from the spool.

It will be clearly understood that, if a prior art publication is referred to herein, this reference does not constitute an admission that the publication forms part of the common general knowledge in the art in Australia or in any other country.

SUMMARY OF INVENTION

The present invention is directed to a spool assembly, which may at least partially overcome at least one of the abovementioned disadvantages or provide the consumer with a useful or commercial choice.

With the foregoing in view, the present invention in one form, resides broadly in a spool assembly comprising a spool, a surface of the spool including one or more recesses in which a line member is adapted to be retained, and a cover portion adapted to be positioned over at least a portion of the spool such that, in use, the line member is prevented from passing between the spool and an inner surface of the cover portion.

The spool may be of any suitable size, shape or orientation. For instance, the spool may be cylindrical, conical, frusto-conical, or the like. Alternatively, the spool may taper inwardly towards the middle, or may have an enlarged middle region and taper towards each end of the spool. The spool may be positioned in any suitable orientation. For instance, the spool may be positioned upright or inverted (in a conical spool, this will mean that the spool will taper towards the bottom). The spool may also be positioned horizontally, or at any suitable angle between the horizontal and the vertical.

The size of the spool (including its height and diameter) may vary depending on a number of factors, including the thickness of the line member, the length of the line member, the size of the door or window opening, the style of door or window being used, the space available in which the spool assembly is to be housed and so on. It will be understood, however, that the specific size and shape of the spool is not critical.

The one or more recesses may be of any suitable form. Preferably, however, the one or more recesses are located on an outer surface of the spool. In a preferred embodiment of the invention, the line member is received in a single continuous recess (or groove) is provided around the spool. More preferably, the line member is received in a continuous helical recess (or groove) that extends around the outer surface of the spool and along at least a portion of the height of the spool. Thus, it is envisaged that the continuous helical recess is in the form of a spiral, such as a conical (or frusto-conical) spiral, the spiral forming a plurality of turns about the spool. In this manner, the line member may be wound onto and off the spool without becoming tangled. It is envisaged that the winding of the line member onto and off the spool will be achieved through the rotation of the spool. Preferably, rotation of the spool in a first direction will result in the line member being wound onto the spool, while rotation of the spool in a second direction opposite to the first direction will result in the line member being wound off the spool.

The spool may be adapted to rotate using any suitable technique. For instance, the spool may be adapted for manual or automatic rotation (using a motor or the like). The rotation of the spool may be achieved using any suitable method. In some embodiments, the spool may be provided on (or with) a spindle, shaft or rod (herein referred to collectively as a "shaft"). In a preferred embodiment of the invention, a spool is located at at least one end of a shaft onto which the flexible screen or blind material is wound. Thus, it is envisaged that a movement of the screen or blind material to cover the opening by extending the screen or blind material across the opening (or, similarly, retracting the screen and blind material to uncover the opening) will cause the shaft to rotate as the blind or screen material is wound onto or off the shaft. The rotation of the shaft may result in a corresponding rotation of the spool. Preferably, the spool and the shaft rotate at the same speed in order to maintain a constant tension in the line member, although it is possible that the spool and shaft may rotate at different speeds (such as by locating a clutch mechanism between the spool and the shaft) if this is required to maintain a constant tension in the line member.

The spool may be provided on the shaft using any suitable technique. For instance, the spool may be fixed to the shaft using any suitable fastening means. Alternatively, the spool may be provided with a connection portion adapted to connect the spool to the shaft.

It is envisaged that one end of the line member may be attached to the spool using any suitable technique. It is also envisaged that a second end of the line member will be attached to the screen or blind material, and preferably to a leading edge (or leading stile) of the screen or blind material. In some embodiments of the invention, a first spool may be located at a first end of the shaft and a first line member may be attached to the first spool and a leading edge of the screen or blind material, while a second spool may be located at a second opposed end of the shaft and a second line member may be attached to the second spool and a leading edge of the screen or blind material. In this embodiment of the invention, it is preferred that the first and second line members do not overlap or intersect. Alternatively, a single spool may be provided at one end of the shaft, and one or more line members may be attached thereto as required.

It is envisaged that, in some embodiments of the invention, a plurality of line members may be wound around a single spool. Thus, in this embodiment, the spool may be provided with a single helical recess into which two or more of the line members may be received, or it may be provided with two or more separate helical recesses, each of which is adapted to receive a single line member.

Preferably, the one or more recesses are of sufficient depth that the line member is retained entirely within the recess. Thus, it is envisaged that the recess will have a greater depth than the diameter of the line member. By providing a recess having a depth greater than the diameter of the line member, the line member may be retained in the recess, and prevented from coming into contact with the cover portion.

The cover portion may be of any suitable size and shape. As previously stated, the cover portion is adapted to cover (or house) at least a portion of the spool. However, in a preferred embodiment of the invention, the spool is housed entirely within the cover portion.

The shape of the cover portion is not critical, and the outer surface of the cover portion may be of any suitable shape. For instance, the outer surface of the cover portion may be shaped to be aesthetically pleasing, or may be shaped so as to fit in the space available in which the spool assembly is to be housed.

It is envisaged, however, that at least a portion of an inner surface of the cover portion may be provided with a complementary shape to an outer surface of the spool. In this way, a uniform distance between the inner surface of the cover portion and the outer surface of the spool may be maintained across substantially the entire height of the spool.

In a preferred embodiment of the invention, the distance between the inner surface of the cover portion and the outer surface of the spool is sufficiently small so as to preclude the line member from moving between the inner surface of the cover portion and the outer surface of the spool. In order to achieve this, it is envisaged that the distance between the inner surface of the cover portion and the outer surface of the spool may be less than the diameter of the line member. In this way, even when a catastrophic loss of tension in the line member occurs, the line member will be unable to move between the cover portion and the spool, thereby preventing the line member becoming disengaged from the spool.

Preferably the cover portion is provided is provided with one or more apertures through which the line member or line members may pass while being wound onto and off the spool. The one or more apertures may be of any suitable shape and location, although it is preferred that the one or more apertures are provided across substantially the entire height of the helical recess. In a preferred embodiment of the invention, the one or more apertures are positioned and/or shaped such that the line member does not make contact with any part of the cover portion when it is being wound onto or off the spool. This prevents damage to both the cover portion and the line member.

Preferably, the cover portion is fixed relative to the spool, so that the cover portion remains in a fixed position when the spool rotates as the line member is wound onto and off the spool.

The cover portion may be fixed relative to the spool using any suitable technique. For instance, in some embodiments of the invention, the cover portion may be fixed directly to a door or window jamb. Alternatively, an attachment member may be attached to the jamb, and the cover portion may be adapted for fixed or temporary engagement to the attachment member using any suitable technique, such as, but not limited to, adhesives, fastening means (including screws, nails, rivets, bolts or the like, or a combination thereof), engagement means such as projections including pins, teeth or the like) or by more permanent fastening techniques such as welding or other heat treatments.

In some embodiments of the invention, the attachment member may be formed integrally with the cover portion. However, it is more preferred that the cover portion is formed separately to the attachment member.

In a preferred embodiment of the invention, the cover portion may be held in engagement with the attachment member, but is not fixedly attached thereto. In this embodiment, the cover portion may be precluded from rotating by this presence of engagement means that engage the pulley with the cover portion. In a preferred embodiment of the invention, the engagement means extend from the attachment member and engage the cover portion in a manner that precludes rotation of the cover portion. More preferably, the engagement means engage the cover portion in a manner that precludes rotation of the cover portion, but does not preclude movement of the cover portion in a vertical and/or horizontal direction. In this way, the cover portion may "float" within the spool assembly. This is particularly advantageous in situations in which it is desirable to have the ability to adjust the vertical or horizontal position of the screen or blind material relative to the door or window opening.

In some embodiments of the invention, the engagement means may be formed integrally with the attachment member. Alternatively, the engagement means may be formed separately to the attachment member and adapted for fixed or temporary attachment thereto.

It is envisaged that the cover portion may be provided with corresponding receiving means adapted to facilitate the engagement (and particularly, the floating engagement) between the engagement means and the cover portion. For instance, if the engagement means comprises one or more teeth, the receiving means may comprise one or more corresponding teeth. Similarly, if the engagement means comprises one or more pins, the receiving means may comprise one or more apertures or bores into which the one or more pins may be received. Preferably, the one or more pins are simply received within the one or more bores and are not engaged therewith or otherwise retained within the one or more bores, as it is envisaged that the position (particularly the vertical position if the shaft is oriented parallel to a vertical edge of the opening, or the horizontal position if the shaft is oriented parallel to a horizontal edge of the opening) of the cover portion (and also the spool and shaft), may be adjusted relative to the attachment member as required. Thus, the one or more pins may be simply received in the one or more bores to enable the cover portion to move (but not to rotate) relative to the attachment member In embodiments of the invention in which the shaft is located parallel to a vertical edge of an opening, it is envisaged that the spool assembly will be located at the upper end of the shaft. In this embodiment, it is preferred that the attachment member may be attached to an upper door or window jamb.

In this embodiment of the invention, it is preferred that a stop member may be provided to provide a support on which the cover portion may be positioned. It is envisaged that the stop member will be located at a position that ensures that the inner surface of the cover portion and the outer surface of the spool are maintained at the desired distance apart.

The stop member may be of any suitable form. For instance, the stop member may comprise an upper end of the shaft, and the cover portion may simply rest on the upper end of the shaft. Alternatively, the upper end of the shaft may be provided with a stop member in the form of a plate, disc or the like on which the cover portion rests. The plate or disc may be formed integrally with the shaft or may be formed separately and adapted for fixed or temporary engagement therewith. In a preferred embodiment of the invention, the stop member is adapted to rotate with the shaft and spool.

In a preferred embodiment of the invention, the spool assembly may be provided with a locking mechanism to prevent rotation of the spool relative to the cover portion. Preferably, the locking mechanism will be used when transporting and installing the spool assembly, although there may be times when the locking mechanism may be engaged after the spool assembly had been installed, such as when maintenance is required.

The locking mechanism may be of any suitable form, and the exact nature of the locking mechanism is not critical, provided that it is suitable for locking the spool against rotation relative to the cover portion.

In one specific embodiment, the locking mechanism may include a locking member (such as a pin, rod or the like). It is envisaged that the locking member may engage with both the cover portion and the spool in order to lock the spool against rotation relative to the cover portion. In one form, this may be achieved by passing the locking member through an aperture in the cover portion and inserting an end of the locking member into a receiving portion of the spool. Thus, the locking member may be received simultaneously in both the cover portion and the spool, thereby preventing rotation of the spool relative to the cover portion.

In other embodiments of the invention, the locking member may include one or more clips. In this embodiment of the invention, the one or more clips may connect the spool to the cover portion, thereby preventing rotation of the spool relative to the cover portion. Alternatively, the one or more clips may be connected to the spool and/or the line member such that the rotation of the spool relative to the cover member is prevented through an abutment between the cover portion and the one or more clips.

Alternatively, the locking member may include one or more zip ties (also known as cable ties) that tie the cover portion to the spool, thereby preventing rotation of the spool relative to the cover portion.

In other embodiments of the invention, the locking member may include one or more lengths of adhesive tape.

In yet another embodiment of the invention, unwanted rotation of the spool relative to the cover portion may be prevented using a magnetic attraction between the spool and the cover portion. In this embodiment of the invention, both the spool and the cover portion may be provided with one or more magnets (for instance, permanent magnets, electromagnets or the like, or a combination thereof). Alternatively, either the spool or the cover portion may be provided with one or more magnets, while the other of the spool or the cover portion may be provided with one or more pieces of ferromagnetic material. It is envisaged that the magnetic attraction between the magnets (or between the magnets and the pieces of ferromagnetic material) will be sufficient to prevent unwanted rotation of the spool relative to the cover portion.

In another aspect, the invention resides broadly in a spool assembly comprising a spool, a surface of the spool including one or more recesses in which a line member is adapted to be received, and a cover portion in which at least a portion of the spool is housed, and wherein the spool is positioned relative to the cover portion so as to ensure that the line member is retained in the one or more recesses.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which.

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way.

DESCRIPTION OF EMBODIMENTS

Figure 1:
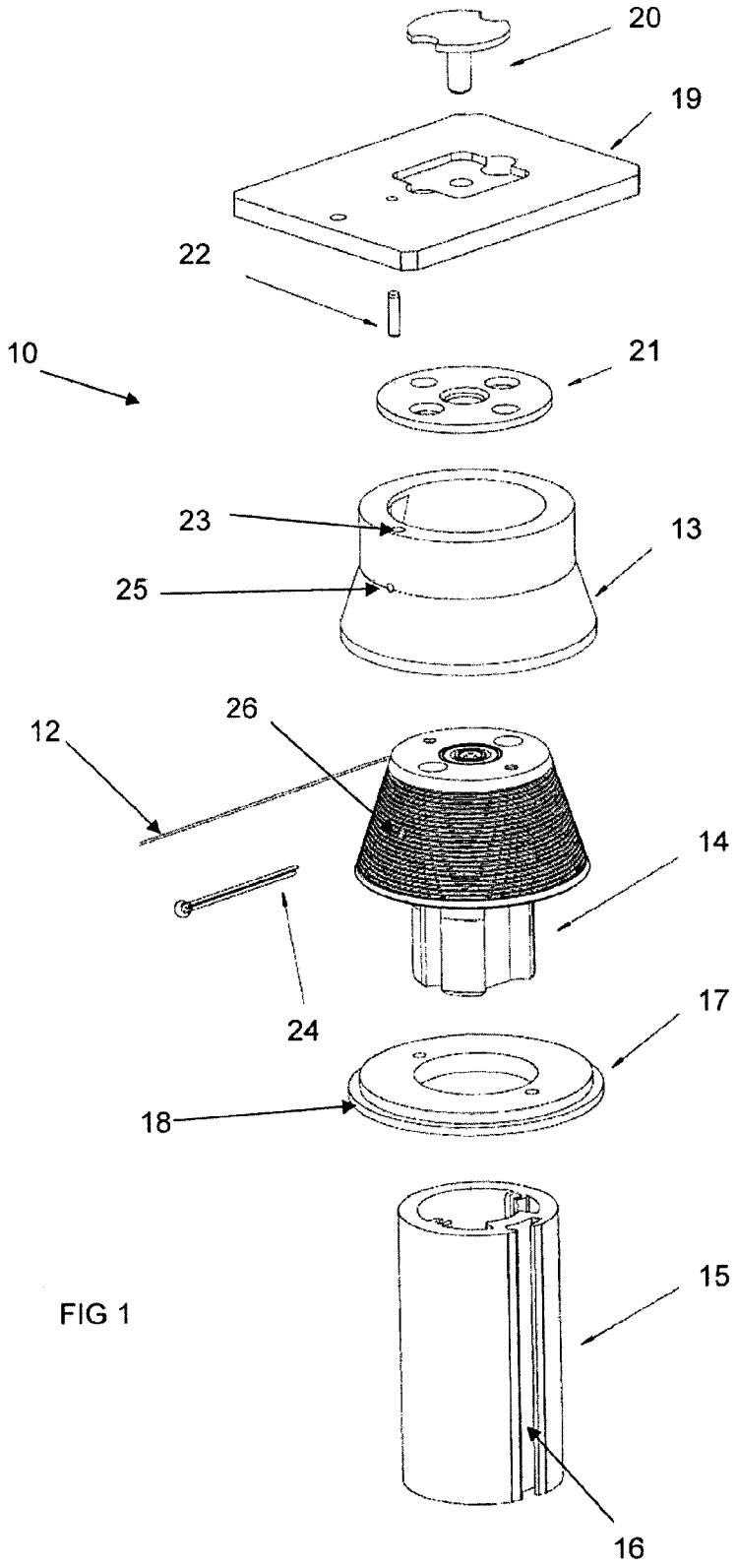
FIG. 1 illustrates an exploded view of a spool assembly according to an embodiment of the present invention.

In FIG. 1 an exploded view of a spool assembly 10 according to an embodiment of the present invention is illustrated. The spool assembly 10 comprises a spool 11 onto which a line member 12 may be wound, and a cover portion 13 that is located over the spool 11 in use.

The spool 11 is provided with a connection portion 14 that is adapted to be received (and retained) in an open end of the shaft 15. In the embodiment of the invention shown in FIG. 1, the connection portion 14 and the shaft 15 are both extruded members, and are provided with cross-sectional shapes that are adapted to be fitted together in a tight frictional engagement.

The shaft 15 is further provided with a channel 16 in which an end of a flexible material (either a blind or screen) is adapted to be received or retained. In this way, a blind or screen (not shown) may be connected to the shaft 15 for winding about the shaft 15.

In the embodiment of the invention shown in FIG. 1, a stop member in the form of a disc 17 is positioned between an upper end of the shaft 15 and a lower end of the spool 11. In use a lower edge of the cover portion 13 rests on a lip or land region 18 of the disc 17. The presence of the disc 17 assists in maintaining a constant distance between an inner surface of the cover portion 13 and an outer surface of the spool 11.

The assembly 10 is provided with an attachment member 19 in the form of a plate or block that is fixed to a door or window jamb (not shown). A bearing pin 20 passes through the attachment member 19 and attached to an upper region of the spool 11. In addition, the assembly 10 is provided with an upper disc 21 which abuts against an upper surface of both the cover portion 13 and the spool 11 and assists in maintaining a constant distance between an inner surface of the cover portion 13 and the spool 11.

Engagement means in the form of a pin 22 extend downwardly from the attachment member 19. The pin 22 is received in a bore 23 in an upper end of the cover portion 13, thereby preventing rotation of the cover portion 13. However, the pin 22 is not engaged with, or otherwise retained in the bore 23, meaning that the cover portion 13 "floats" within the assembly, and vertical movement of the cover portion 13 relative to the attachment member 19 is possible if adjustment of the vertical positioning of the spool assembly 10 is required.

When the spool assembly 10 is being transported and installed, it is desirable to prevent the spool 11 rotating relative to the cover portion 13, as this can lead to the unwanted unwinding of the line member 12 from the spool 11. Thus, a locking pin 24 is provided to lock the spool 11 against rotation relative to the cover portion 13. The locking pin 24 passes through an aperture 25 in the cover portion 13 and is received in an aperture or recess 26 in the spool 11. In this way, the spool 11 and the cover portion 13 may be locked to one another as required.

Figure 2A:
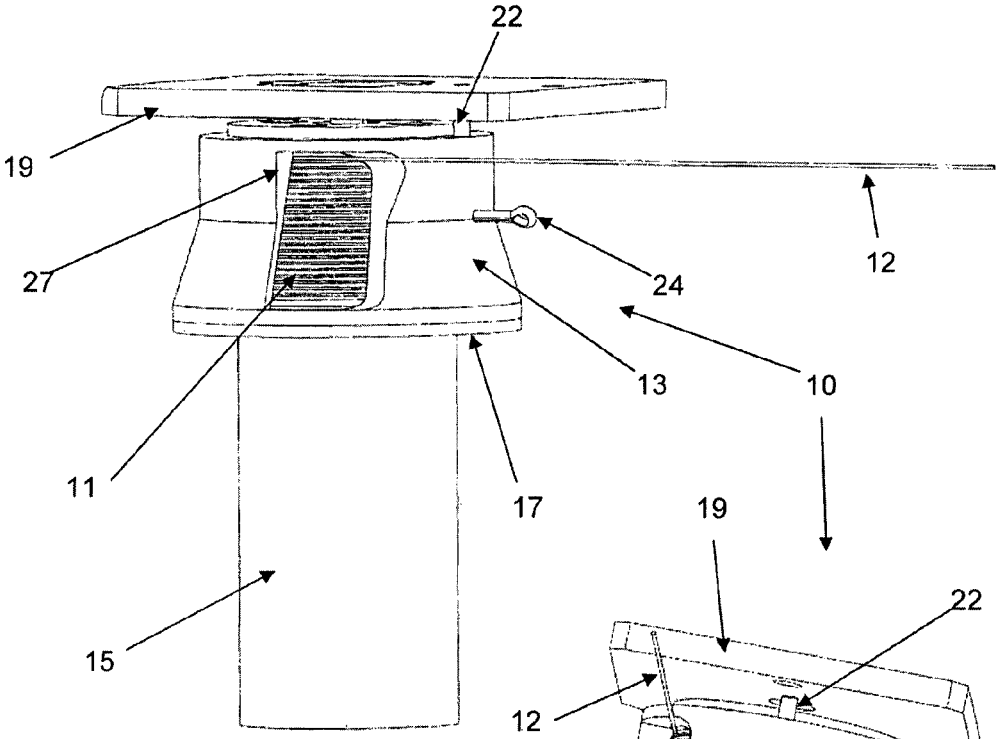
FIGS. 2A and 2B illustrate perspective views of a spool assembly according to an embodiment of the present invention.
Figure 2B:
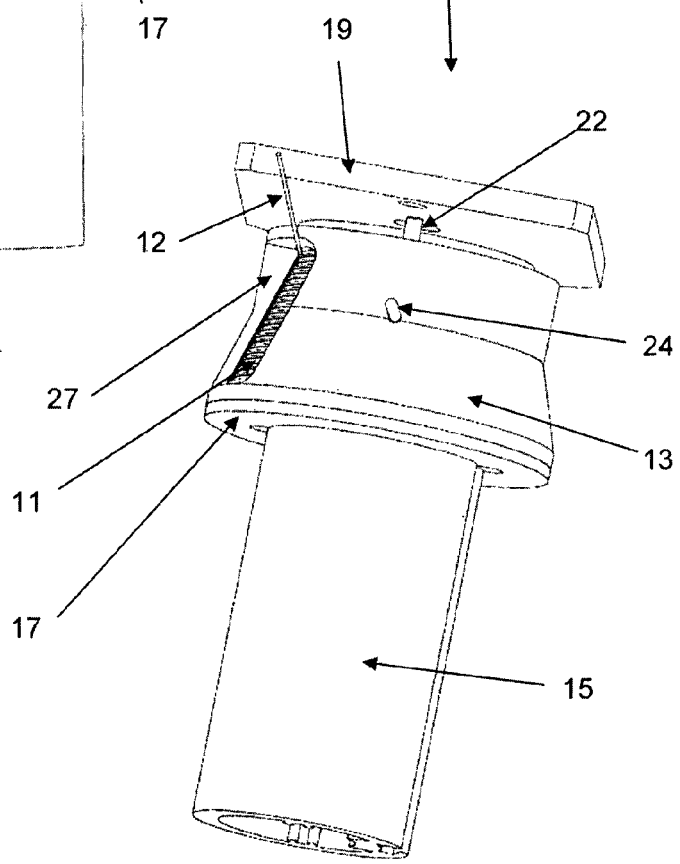

Turning now to FIGS. 2A and 2B there are shown perspective views of the spool assembly 10 according to an embodiment of the present invention. In these Figures, the spool assembly 10 of FIG. 1 is shown in an assembled condition.

In FIGS. 2A and 2B, the locking pin 24 is inserted through the cover portion 13 and is received in the spool 11, thereby locking the spool 11 against rotation relative to the cover portion 13. Pin 22 extends downwardly from the attachment member 19 and is received in a bore (obscured) in an upper surface of the cover portion 13, thereby preventing rotation of the cover portion 13.

In these Figures, the spool 11 is connected to the shaft 15, and the cover portion 13 is positioned over the spool 11 and rests on disc 17.

Line member 12 is wound about the spool 11. As the line member 12 is wound onto and off the spool 11 it passes through opening 27 in the cover portion 13. The opening 27 is positioned so as to ensure that the line member 12 does not come into contact with any part of the cover portion 13 as it is wound on and off the spool 11. Further, the edges of the opening 27 may be shaped so as to provide additional clearance between the cover portion 13 and the line member 12.

Figures 3A, 3B:
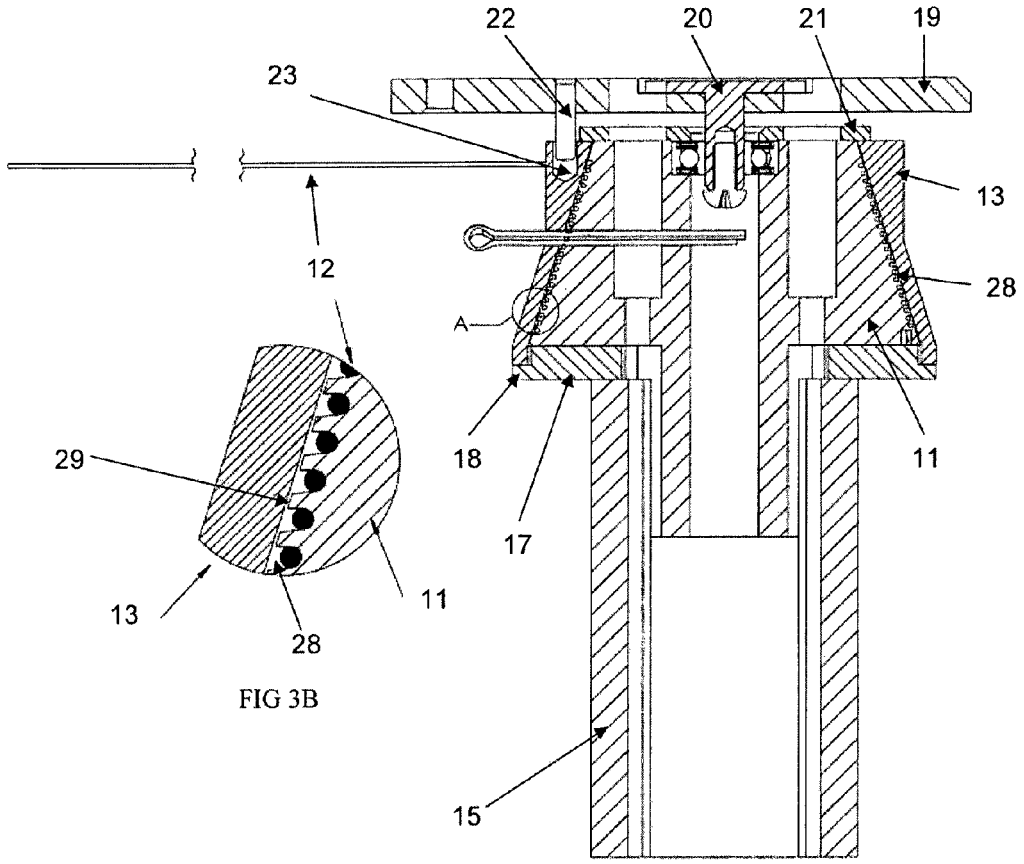
FIGS. 3A and 3B illustrate a cross-sectional view of a spool assembly according to an embodiment of the present invention.

In FIG. 3A there is shown a cross-sectional view of a spool assembly 10 according to an embodiment of the present invention. In this Figure it may be seen that the pin 22 extending downwardly from the attachment portion 19 is received in the bore 23. The bore 23 extends into the cover portion 13, meaning that the vertical position of the cover portion 13 relative to the attachment member 19 may be adjusted as required.

In this Figure it may be clearly seen that the upper disc 21 abuts both the upper end of the cover portion 13 and the spool 11. Similarly, the cover portion 13 rests on a lip or land portion 18 of the stop member 17, while the lower end of the spool also rests on the stop member 17. In this way, a constant distance between the inner surface of the cover portion 13 and the spool 11 is maintained.

It may also be seen more clearly in this Figure that the bearing pin 20 is inserted into, and retained within, an upper region of the spool 11, thereby facilitating rotation of the spool 11 and shaft 15.

The surface of the spool 11 is provided with a helical recess or groove 28 into which the line member 12 is received when wound about the spool 11. The helical recess or groove 28 may be more clearly seen in FIG. 3B which is a magnified view of Region A of FIG. 3A.

In FIG. 3B it can be clearly seen that the line member 12 is retained in the recess or groove 28 provided on the surface of the spool 11. The recess or groove 28 is of sufficient depth that the line member 12 is entirely received within the recess or groove 28. In other words, the depth of the recess or groove 28 is greater than the diameter of the line member 12. In this way, no part of the line member 12 will come into contact with the inner surface of the cover portion 13 when the line member 12 is at the desired tension.

It will also be noted in FIG. 3B that the gap 29 between the inner surface of the cover portion 13 and the spool 11 is small enough so that the line member 12 is unable to pass between the inner surface of the cover portion 13 and the spool 11. In this way, even in the event of a catastrophic loss of tension in the line member 12, the line member 12 will be retained in the recess or groove 28 on the spool 11. This means that repairing the loss of tension in the line member 12 will be relatively quick and easy, and a user will not be required to wind the line member 12 back onto the spool 11, which would be the case if the cover portion 13 was not present, or if the line member 12 was not prevented from passing between the inner surface of the cover portion 13 and the spool 11.

In the present specification and claims (if any), the word 'comprising' and its derivatives including 'comprises' and 'comprise' include each of the stated integers but does not exclude the inclusion of one or more further integers.

Reference throughout this specification to 'one embodiment' or an 'embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. The spool assembly comprising a line member, a frustoconical spool, an outer surface of the spool including one or more recesses adapted to retain the line member therein, and a cover portion adapted to be positioned over at least a portion of the spool, wherein at least a portion of an inner surface of the cover portion is provided with a complementary shape to the outer surface of the spool such that, in use, the distance between the inner surface of the cover portion and the outer surface of the spool is less than the diameter of the line member so as to preclude the line member from moving between the inner surface of the cover portion and the outer surface of the spool, and wherein the spool assembly is provided with a locking mechanism to prevent rotation of the spool relative to the cover portion during transportation or installation.

2. The spool assembly according to claim 1 wherein the spool is adapted to retain the line member in a single continuous recess around the spool.

3. The spool assembly according to claim 1 in which the spool is located at an end of a shaft onto which a flexible screen or blind material may be wound.

4. The spool assembly according to claim 1 wherein the one or more recesses are of sufficient depth to retain the line member entirely within the recess.

5. The spool assembly according to claim 1 wherein the spool is housed entirely within the cover portion.

6. The spool assembly according to claim 1 wherein the cover portion is fixed relative to the spool.

7. The spool assembly according to claim 1 wherein the cover portion is precluded from rotation relative to the spool but is not precluded from movement in at least one of a vertical direction and a horizontal direction.

8. The spool assembly according to claim 1 wherein the spool assembly further comprises a stop member located so as to ensure that the inner surface of the cover portion and the outer surface of the spool are maintained a desired distance apart.

9. The spool assembly according to claim 1 wherein the cover portion is provided with one or more apertures through which the line members pass while being wound onto and off the spool.

10. The spool assembly according to claim 1 wherein the locking mechanism includes a locking member that engages with both the cover portion and the spool in order to lock the spool against rotation relative to the cover portion.

11. The spool assembly comprising a frustoconical spool, an outer surface of the spool including one or more recesses adapted to retain a line member therein, and a cover portion in which at least a portion of the spool is housed, at least a portion of an inner surface of the cover portion being provided with a complementary shape to the outer surface of the spool and wherein the spool is positioned relative to the cover portion such that the distance between the inner surface of the cover portion and the outer surface of the spool is less than the depth of said recesses so as to ensure that the line member is retained in the one or more recesses, and wherein the spool assembly is provided with a locking mechanism to prevent rotation of the spool relative to the cover portion during transportation or installation.

* * * * *